United States Patent [19]

Allen

[11] 3,987,853

[45] *Oct. 26, 1976

[54] METHOD FOR INCREASING THE OIL RECOVERY FROM ACTIVE WATER DRIVE RESERVOIRS

[75] Inventor: Joseph C. Allen, Bellaire, Tex.

[73] Assignee: Texaco Inc., New York, N.Y.

[ * ] Notice: The portion of the term of this patent subsequent to June 4, 1991, has been disclaimed.

[22] Filed: June 23, 1975

[21] Appl. No.: 589,095

Related U.S. Application Data

[63] Continuation of Ser. No. 183,911, Sept. 27, 1971.

[52] U.S. Cl. ..... 166/272; 166/303

[51] Int. Cl.[2] ..... E21B 43/24

[58] Field of Search ..... 166/266, 272, 279, 303, 166/309

[56] References Cited

UNITED STATES PATENTS

| | | | |
|---|---|---|---|
| 2,724,437 | 11/1955 | Whorton et al. | 166/266 |
| 3,480,081 | 11/1969 | Felsenthal et al. | 166/303 |
| 3,814,186 | 6/1974 | Allen | 166/272 |

OTHER PUBLICATIONS

Frick, "Petroleum Production Handbook" (vol. II--Reservoir Eng.), 1962, pp. 33–27.

*Primary Examiner*—Ernest R. Purser
*Assistant Examiner*—Jack E. Ebel
*Attorney, Agent, or Firm*—Thomas H. Whaley; Carl G. Ries; Kenneth R. Priem

[57] ABSTRACT

A method is provided for increasing oil recovery from reservoirs which have an active water drive so that the reservoir pressure remains essentially constant during the production of oil from the reservoir. The method entails establishing a free gas saturation by injecting a hot fluid into the reservoir so that bubbles of gas will form due to the increased temperature and be held suspended in the reservoir. An additional amount of oil about equal to the irreducible gas saturation will be displaced by the encroaching aquifer and produced.

5 Claims, 4 Drawing Figures

NO GAS SATURATION

BELOW CRITICAL GAS SATURATION

ABOVE CRITICAL GAS SATURATION

METHOD FOR INCREASING THE OIL RECOVERY FROM ACTIVE WATER DRIVE RESERVOIRS

This is a continuation of application Ser. No. 183,911, filed Sept. 27, 1971.

BACKGROUND OF THE INVENTION

1. Field of the Invention

This invention pertains to the field of oil recovery from subterranean reservoirs.

2. Discussion of the Prior Art

In the recovery of oil from reservoirs by water displacement the presence of a free gas saturation will increase oil recovery by an amount about equal to the irreducible gas saturation. The irreducible gas saturation is the lowest saturation the gas can be reduced to by encroachment of water. As oil is produced from some oil reservoirs, especially those with little or no water drive, the pressure in the reservoir is reduced and bubbles of gas evolve from the oil in the reservoir which provide the energy to force the oil to the surface. This gas being in the form of gas in the reservoir is called free gas. The amount of free gas present is called the free gas saturation. However, in reservoirs with a very active water drive where the water encroaches as fast as oil is produced the pressure in the reservoir may not decline appreciably as oil is produced. The encroaching water may keep the pressure essentially constant throughout the productive life of the reservoir, consequently no gas will evolve from solution in the oil. It is, therefore, an object of this invention to provide a method whereby gas evolution will take place in a reservoir with an active water drive and thereby increase the oil recovery by an amount equal to the irreducible gas saturation.

SUMMARY OF THE INVENTION

The invention is a method whereby oil is produced from a subterranean oil reservoir through one or more wells penetrating the reservoir, the reservoir containing gas in solution and having an active water drive so that the pressure in the reservoir remains essentially constant while oil is being produced. A hot fluid is injected into the reservoir to liberate gas from the oil in the reservoir.

DESCRIPTION OF PREFERRED EMBODIMENTS

It has been demonstrated that in reservoirs swept by an active water drive the remaining nonwetting phase saturation, oil and gas, after water encroachment will remain constant. Therefore, if a free gas saturation can be established, the amount of oil left after water encroachment will be less and more oil will be produced. The process of my invention proposes to introduce a free gas saturation in a reservoir with an active water drive by raising the temperature of the oil in the reservoir so that gas will evolve from solution. If the temperature is kept at or below the point of critical gas saturation where the free gas will begin to flow the gas will be in the form of isolated bubbles in the reservoir. The encroaching water will sweep out the oil leaving an amount of gas equal to the irreducible gas saturation. Since saturation of this irreducible gas and reservoir oil after water encroachment will be constant, the amount of oil recovered will increase by an amount equal to the irreducible gas saturation.

The hot fluid may be injected simultaneously as oil is being produced from the reservoir or alternatively, it may be injected in the reservoir while no production is taking place. When the temperature of the reservoir is such that the critical gas saturation has been just reached then the injection of the hot fluid should cease to avoid excessive gas production, but production of oil should begin or continue allowing the acquifer to encroach upon the oil column as oil is produced from it. The oil is produced by the encroaching aquifer by conventional means within the knowledge of one skilled in the art of oil production.

The hot fluid being injected into the reservoir is preferably water or steam since water is commonly found in the oil field and will normally be compatible with the reservoir fluid. The water may be fresh or have dissolved salts in it. Any inexpensive noncontaminating fluid, however will be satisfactory for the process of my invention.

This invention is applicable to any reservoir which contains dissolved gas and having an active water drive so that the reservoir pressure will not decline appreciably during oil production and consequently, the reservoir will not naturally attain a free gas saturation.

The drawings illustrate the improvement to be realized with my invention.

Figure 1:
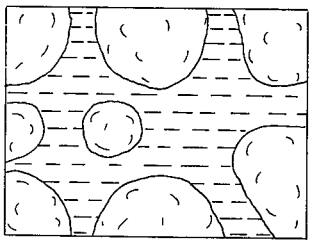
FIGS. 1, 2 and 3 are idealized microscopic illustration of portions of an oil reservoir having no free gas saturation, having a gas saturation below the critical gas saturation, and having a gas saturation above the critical gas saturation, respectively.

FIG. 1 is an idealized microscopic illustration of a portion of an oil reservoir which has no free gas saturation. All gas exists in solution with the oil.

Figure 2:
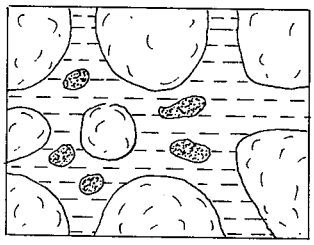

FIG. 2 is an idealized microscopic illustration of a portion of an oil reservoir which is below the critical gas saturation point. The bubbles of gas are separate bubbles and do not flow.

Figure 3:
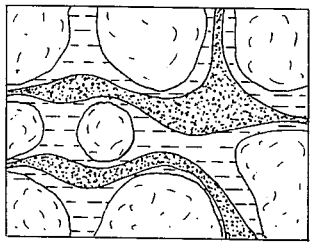
Figure 3:
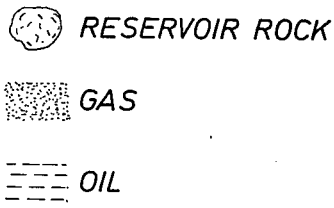

FIG. 3 is an idealized microscopic illustration of a portion of an oil reservoir which is above the critical gas saturation point. The gas is now a continuous phase and will flow in the reservoir with the oil.

Figure 4:
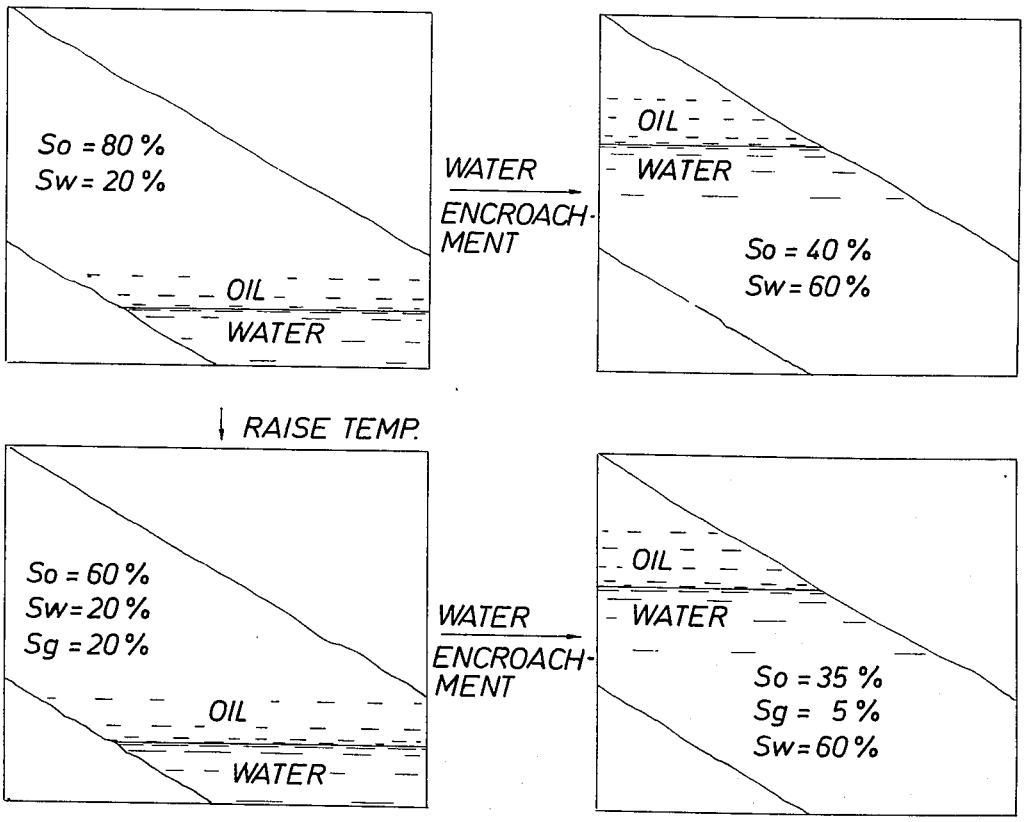
FIG. 4 illustrates the gas and oil recovery in a water drive reservoirs having a free gas saturation and having no free gas saturation.

FIG. 4 depicts the effect of water on a reservoir with no free gas saturation and the same reservoir with a free gas saturation of 20%. With no free gas saturation a residual oil saturation of 40% is left after water encroachment. With a free gas saturation before water encroachment a residual oil saturation of 35% is left after water encroachment. This represents a gain of additional oil from 50% to 56% in oil recovery.

I claim:

1. A method whereby oil is produced from a subterranean oil reservoir having an active water drive and containing gas in solution which is penetrated by at least one injection well and the production well the improvements which comprise:

injecting a hot fluid into said reservoir via said injection well the hot fluid being at a temperature sufficient to liberate the dissolved gas from the oil in the reservoir and simultaneously producing oil from the reservoir while injecting said hot fluid while the pressure in the reservoir remains essentially constant.

2. A method as in claim 1 wherein the hot fluid is water.

3. A method as in claim 1 wherein the hot fluid is steam.

4. A method as in claim 2 wherein the temperature of the reservoir is kept below the point of critical gas saturation.

5. A method as in claim 3 wherein the temperature of the reservoir is kept below the point of critical gas saturation.

* * * * *